US011719475B2

(12) United States Patent
Yang et al.

(10) Patent No.: US 11,719,475 B2
(45) Date of Patent: Aug. 8, 2023

(54) REFRIGERANT REGENERATING APPARATUS

(71) Applicant: LG ELECTRONICS INC., Seoul (KR)

(72) Inventors: Hongjoo Yang, Seoul (KR); Byoungjin Ryu, Seoul (KR); Wooho Cha, Seoul (KR); Chungwoo Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 143 days.

(21) Appl. No.: 17/410,067

(22) Filed: Aug. 24, 2021

(65) Prior Publication Data

US 2022/0065508 A1 Mar. 3, 2022

(30) Foreign Application Priority Data

Aug. 25, 2020 (KR) ..... 10-2020-0107012

(51) Int. Cl.
*F25B 45/00* (2006.01)
*F25B 31/00* (2006.01)

(52) U.S. Cl.
CPC ..... *F25B 45/00* (2013.01); *F25B 31/002* (2013.01)

(58) Field of Classification Search
CPC .. F25B 45/00; F25B 31/002; F25B 2345/002; F25B 43/02; B03C 2201/02; B03C 3/025; B03C 3/08; B03C 3/06; B03C 3/21; B03C 3/41; B03C 3/47; B03C 3/49; B03C 1/00; H01T 19/00
See application file for complete search history.

(56) References Cited

U.S. PATENT DOCUMENTS 2,691,280 A 10/1954 Albert

FOREIGN PATENT DOCUMENTS

| | | | |
|---|---|---|---|
| JP | 2011-005440 | | 1/2011 |
| JP | 2011-196636 | | 10/2011 |
| JP | 2013-146677 | | 8/2013 |
| KR | 20200112384 A | * | 10/2020 |
| KR | 20230023354 A | * | 2/2023 |

OTHER PUBLICATIONS

European Search Report dated Jan. 4, 2022 issued in Application No. 21192793.4.

* cited by examiner

*Primary Examiner* — Kun Kai Ma
(74) *Attorney, Agent, or Firm* — Ked & Associates

(57) ABSTRACT

A refrigerant regenerating apparatus is disclosed. A refrigerant regenerating apparatus of the present disclosure includes: a regenerator into which a refrigerant flows and from which the refrigerant is discharged, the regenerator configured to separate and discharge oil contained in a refrigerant flowing in the regenerator; and a recoverer into which the refrigerant discharged from the regenerator flows, the recoverer including a compressor configured to compress a refrigerant flowing in the recoverer and a heat exchanger configured to condense a refrigerant discharged from the compressor, in which the regenerator includes: a charger configured to charge oil contained in the refrigerant flowing in the regenerator with positive ions or negative ions using corona discharge; and a collector configured to electrically collect the oil charged through the charger.

14 Claims, 12 Drawing Sheets

REFRIGERANT REGENERATING APPARATUS

CROSS-REFERENCE TO RELATED APPLICATION

This application claims the priority benefit of Korean Patent Application No. 10-2020-0107012, filed on Aug. 25, 2020, the disclosure of which is incorporated herein by reference in its entirety.

BACKGROUND OF THE DISCLOSURE

Field of the Disclosure

The present disclosure relates to a refrigerant regenerating apparatus. In particular, the present disclosure relates to a refrigerant regenerating apparatus that can separate and remove oil from a refrigerant using corona discharge.

Related Art

In general, a refrigerant regenerating apparatus is an apparatus that recovers and regenerates a refrigerant used as a working fluid in an air conditioner. Oil may be supplied to a compressor of the air conditioner as a lubricant for smooth operation of the compressor.

In the case, the refrigerant regenerating apparatus can regenerate the recovered refrigerant by separating and removing oil from the refrigerant, and the regenerated refrigerant can be supplied back into the air conditioner as a working fluid.

Recently, there are many studies about a method of increasing the separation ratio of a refrigerant and oil and a method that can selectively collect oil separated from a refrigerant, using a refrigerant regenerating apparatus.

SUMMARY OF THE DISCLOSURE

An object of the present disclosure is to solve the problems described above and other problems.

Another object may be to provide a refrigerant regenerating apparatus that can electrically separate a refrigerant and oil by charging oil contained in a refrigerant to have one polarity using corona discharge.

Another object may be to provide a refrigerant regenerating apparatus that can remove charged oil from a refrigerant by electrically collecting the charged oil.

In order to achieve the objects described above or other objects of the present disclosure, there is provided a refrigerant regenerating apparatus including: a regenerator into which a refrigerant flows and from which the refrigerant is discharged, the regenerator configured to separate and discharge oil contained in a refrigerant flowing in the regenerator; and a recoverer into which the refrigerant discharged from the regenerator flows, the recoverer including a compressor configured to compress a refrigerant flowing in the recoverer and a heat exchanger configured to condense a refrigerant discharged from the compressor, in which the regenerator includes: a charger configured to charge oil contained in the refrigerant flowing in the regenerator with positive ions or negative ions using corona discharge; and a collector configured to electrically collect the oil charged through the charger.

DESCRIPTION OF EXEMPLARY EMBODIMENTS

Figure 1:
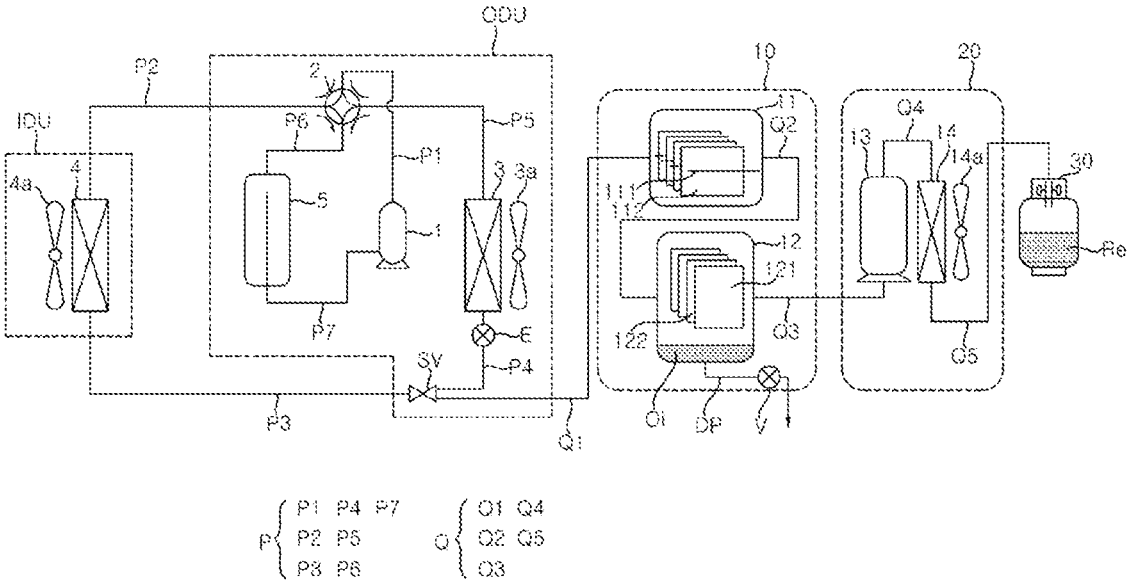
FIG. 1 is a view illustrating that a refrigerant regenerating apparatus according to an embodiment of the present disclosure recovers and regenerates a refrigerant from an air conditioner.

Hereafter, embodiments of the present disclosure will be described in detail with reference to the accompanying drawings and the same or similar components are given the same reference numerals regardless of the numbers of figures and are not repeatedly described.

Terms "module" and "unit" that are used for components in the following description are used only for the convenience of description without having discriminate meanings or functions.

In the following description, if it is decided that the detailed description of known technologies related to the present disclosure makes the subject matter of the embodiments described herein unclear, the detailed description is omitted. Further, the accompanying drawings are provided only for easy understanding of embodiments disclosed in the specification, the technical spirit disclosed in the specification is not limited by the accompanying drawings, and all changes, equivalents, and replacements should be understood as being included in the spirit and scope of the present disclosure.

Terms including ordinal numbers such as 'first', 'second', etc., may be used to describe various components, but the components are not to be construed as being limited to the terms. The terms are used only to distinguish one component from another component.

It is to be understood that when one element is referred to as being "connected to" or "coupled to" another element, it may be connected directly to or coupled directly to another element or be connected to or coupled to another element, having the other element intervening therebetween. On the other hand, it should to be understood that when one element is referred to as being "connected directly to" or "coupled directly to" another element, it may be connected to or coupled to another element without the other element intervening therebetween.

Singular forms are intended to include plural forms unless the context clearly indicates otherwise.

It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Referring to FIG. 1, an air conditioner may include an outdoor unit ODU and an indoor unit IDU. The outdoor unit ODU may include a compressor 1, a switch valve 2, an outdoor heat exchanger 3, an expansion valve E, and an accumulator 5. The indoor unit IDU may include an indoor heat exchanger 4. The outdoor unit ODU and the indoor unit IDU may be connected to each other by a refrigerant pipe P through which a refrigerant flows.

The compressor 1 can discharge a high-temperature and high-pressure refrigerant by compressing a refrigerant flowing inside from the accumulator 5. A seventh refrigerant pipe P7 is installed between the accumulator 5 and the compressor 1, thereby being able to provide a refrigerant channel connected from the accumulator 5 to the compressor 1. A first refrigerant pipe P1 is installed between the compressor 1 and the switch valve 2, thereby being able to provide a refrigerant channel connected from the compressor 1 to the switch valve 2.

A refrigerant discharged from the compressor 1 and passing through the first refrigerant pipe P1 can flow into the switch valve 2. The switch valve 2 can selectively guide the refrigerant, which flows inside through the first refrigerant pipe P1, to the outdoor heat exchanger 3 or the indoor heat exchanger 4. For example, the switch valve 2 may be a 4-way valve. A sixth refrigerant pipe P6 is installed between the switch valve 2 and the accumulator 5, thereby being able to provide a refrigerant channel connected from the switch valve 2 to the accumulator 5.

The outdoor heat exchanger 4 can perform heat exchange between a refrigerant and outdoor air. The heat transfer direction between the refrigerant and the outdoor air in the outdoor heat exchanger 4 may depend on the operation mode of the air conditioner, that is, whether it is a cooing operation or a heating operation. An outdoor fan 3*a* is disposed at a side of the outdoor heat exchanger 3 and can adjust the amount of air that is provided to the outdoor heat exchanger 3. For example, the outdoor fan 3*a* may be driven by a motor (not shown). A fifth refrigerant pipe P5 is installed between the switch valve 2 and the outdoor heat exchanger 3, thereby being able to provide a refrigerant channel connecting the switch valve 2 and outdoor heat exchanger 3.

The expansion valve E is installed between the outdoor heat exchanger 3 and the indoor heat exchanger 4 and may be installed in the pipe connecting the outdoor heat exchanger 3 and the indoor heat exchanger 4. For example, the pipe connecting the outdoor heat exchanger 3 and the indoor heat exchanger 4 may include a third refrigerant pipe P3 and the fourth refrigerant pipe P4 connected to each other by a service valve SV. In this case, the third refrigerant pipe P3 may be installed between the indoor heat exchanger 4 and the service valve SV. The fourth refrigerant pipe P4 is installed between the outdoor heat exchanger 3 and the service valve SV, and the expansion valve E may be installed in the fourth refrigerant pipe P4. The expansion valve E can expand the refrigerant provided from any one of the outdoor heat exchanger 3 and the indoor heat exchanger 4 into a low-temperature and low-pressure state, depending on the operation mode of the air conditioner. For example, the expansion valve E may be an EEV (Electronic Expansion Valve).

The indoor heat exchanger 4 can perform heat exchange between a refrigerant and indoor air. The heat transfer direction between the refrigerant and the indoor air in the indoor heat exchanger 4 may depend on the operation mode of the air conditioner, that is, whether it is a cooing operation or a heating operation. An indoor fan 4*a* is disposed at a side of the indoor heat exchanger 4 and can adjust the amount of air that is provided to the indoor heat exchanger 4. For example, the indoor fan 4*a* may be driven by a motor (not shown). A second refrigerant pipe P2 is installed between the indoor heat exchanger 4 and the switch valve 2, thereby being able to provide a refrigerant channel connecting the indoor heat exchanger 4 and the switch valve 2.

A controller C (not shown) can control operation of the air conditioner. The controller C may be electrically connected to each of the components of the air conditioner. The controller C can control operation of the switch valve 2 and the expansion valve E, depending on the operation mode of the air conditioner. The controller C can control the driving frequency (Hz) of the compressor 1, depending on the operation mode of the air conditioner.

<Heating Operation Mode of Air Conditioner>

Referring to the solid-line arrows shown around the switch valve 2, when the air conditioner receives a heating operation signal, the controller C can perform a heating operation of the air conditioner. For example, the heating operation signal may be a signal that is optionally input by a user. As another example, the heating operation signal may be a signal that a thermostat installed in the interior provides to the controller C when an indoor temperature sensed by an indoor temperature sensor is lower than a set desired temperature over a predetermined level.

In detail, a low-temperature and low-pressure refrigerant flowing into the compressor 1 from the accumulator 5 through the seventh refrigerant pipe 7 can be compressed through the compressor 1 and then discharged in a high-temperature and high-pressure state. The refrigerant discharged from the compressor 1 can flow into the indoor heat exchanger 4 sequentially through the first refrigerant pipe P1, the switch valve 2, and the second refrigerant pipe P2.

Heat energy transfers to the indoor air from the refrigerant in the indoor heat exchanger 4, whereby the refrigerant can be condensed. In this case, the indoor heat exchanger 4 can function as a condenser. Further, heat is exchanged between the refrigerant and the indoor air, whereby the interior can be heated. The refrigerant condensed through the indoor heat exchanger 4 can flow into the third refrigerant pipe P3 and the fourth refrigerant pipe P4. The refrigerant flowing through the fourth refrigerant pipe P4 can expand into a low-temperature and low-pressure state through the expansion valve E and then can flow into the outdoor heat exchanger 3.

Heat energy of the outdoor air transfers to the refrigerant in the outdoor heat exchanger 3, whereby the refrigerant can be evaporated. In this case, the outdoor heat exchanger 3 can function as an evaporator. The refrigerant evaporated through the outdoor heat exchanger 3 can flow into the compressor 1 sequentially through the fifth refrigerant pipe P5, the switch valve 2, the sixth refrigerant pipe P6, the accumulator 5, and the seventh refrigerant pipe P7. Accordingly, a refrigerant cycle for the heating operation of the air conditioner can be completed.

<Cooling Operation Mode of Air Conditioner>

Referring to the dotted-line arrows shown around the switch valve 2, when the air conditioner receives a cooling operation signal, the controller C can perform a cooling operation of the air conditioner. For example, the cooling operation signal may be a signal that is optionally input by a user. As another example, the cooling operation signal may be a signal that a thermostat installed in the interior provides to the controller C when an indoor temperature sensed by an indoor temperature sensor is higher than a set desired temperature over a predetermined level.

In detail, a low-temperature and low-pressure refrigerant flowing into the compressor 1 from the accumulator 5 through the seventh refrigerant pipe 7 can be compressed through the compressor 1 and then discharged in a high-temperature and high-pressure state. The refrigerant discharged from the compressor 1 can flow into the indoor heat exchanger 3 sequentially through the first refrigerant pipe P1, the switch valve 2, and the fifth refrigerant pipe P5.

Heat energy transfers to the outdoor air from the refrigerant in the outdoor heat exchanger 3, whereby the refrigerant can be condensed. In this case, the outdoor heat exchanger 3 can function as a condenser. The refrigerant condensed through the outdoor heat exchanger 3 can flow into the fourth refrigerant pipe P4 and the third refrigerant pipe P3. The refrigerant flowing through the fourth refrigerant pipe P4 can expand into a low-temperature and low-pressure state through the expansion valve E and then can flow into the indoor heat exchanger 4.

Heat energy of the indoor air transfers to the refrigerant in the indoor heat exchanger 4, whereby the refrigerant can be evaporated. In this case, the indoor heat exchanger 4 can function as an evaporator. Further, heat is exchanged between the refrigerant and the indoor air, whereby the interior can be cooled. The refrigerant evaporated through the indoor heat exchanger 4 can flow into the compressor 1 sequentially through the second refrigerant pipe P2, the switch valve 2, the sixth refrigerant pipe P6, the accumulator 5, and the seventh refrigerant pipe P7. Accordingly, a refrigerant cycle for the cooling operation of the air conditioner can be completed.

The compressor 1 may be an oil compressor that employs oil as a lubricant. In this case, the air conditioner may include an oil separator that separates oil from the refrigerant discharged from the compressor 1 and then supplies the oil back to the compressor 1. However, as the operation time of the air conditioner is accumulated, the content of oil in the refrigerant flowing through the refrigerant pipe P may increase, so it is required to recover and regenerate the refrigerant from the aid conditioner. Further, it is required to separate and remove oil, so the refrigerant that is recovered and regenerated to the refrigerant regenerating apparatus may be referred to as a recovered refrigerant.

Figure 2:
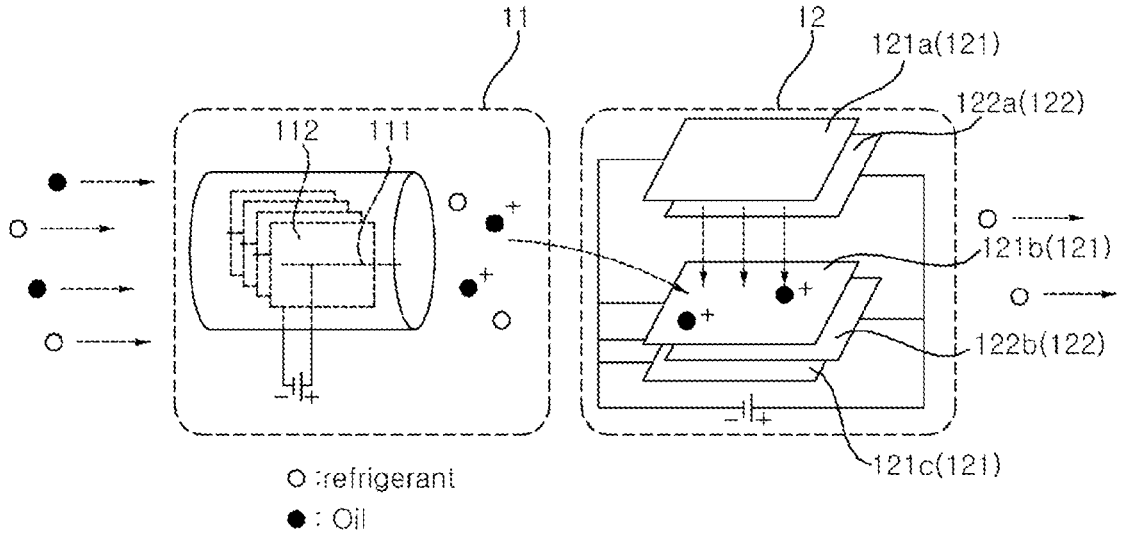
FIG. 2 is a view illustrating a charger and a collector of a regenerator of the refrigerant regenerating apparatus according to an embodiment of the present disclosure.

Referring to FIGS. 1 and 2, the refrigerant regenerating apparatus can recover a refrigerant from an air conditioner and separate and remove oil from the recovered refrigerant.

For example, a first pipe Q1 of the refrigerant regenerating apparatus may be connected to the refrigerant pipe P of the air conditioner through the service valve SV. In this case, the refrigerant regenerating apparatus can recover a refrigerant from the air conditioner through the first pipe Q1.

As another example, the refrigerant used by an air conditioner or other devices can be collected in a storage tank (not shown). In this case, the first pipe Q1 of the refrigerant regenerating apparatus may be connected to the storage tank, whereby the refrigerant stored in the storage tank can be recovered from the storage tank.

The refrigerant that is recovered or sent into the refrigerant regenerating apparatus may be a gaseous refrigerant.

For example, an expansion valve (not shown) may be installed in the first pipe Q1 and can expand the refrigerant flowing through the first pipe Q1. That is, a liquid refrigerant flowing into the first pipe Q1 may change the phase into a two-phase refrigerant having a liquid state and a gas state while passing through the expansion valve. In this case, the gaseous refrigerant of the two-phase refrigerant is provided to the refrigerant regenerating apparatus and the liquid refrigerant is returned to the expansion valve, and this process is repeated, whereby the gaseous refrigerant can flow in to the refrigerant regenerating apparatus. In this process, oil may be contained in a mist state in the gaseous refrigerant flowing into the refrigerant regenerating apparatus.

As another example, a heater (not shown) may be installed in the first pipe Q1 and can evaporate the refrigerant flowing through the first pipe Q1. That is, a liquid refrigerant flowing into the first pipe Q1 may be changed in state into a two-phase refrigerant or a gaseous refrigerant by the heater. In this case, the gaseous refrigerant of the two-phase refrigerant is provided to the refrigerant regenerating apparatus and the liquid refrigerant is returned to pass through the heater, and this process is repeated, whereby the gaseous refrigerant can flow in to the refrigerant regenerating apparatus. In this process, oil may be contained in a mist state in the gaseous refrigerant flowing into the refrigerant regenerating apparatus. The heater may be an electric heater or a heating pipe through which a high-temperature heat transfer medium circulating through a specific closed loop (e.g., a refrigerant discharged from a separate compressor) flows.

As another example, both of the expansion valve and the heater may also be installed in the first pipe Q1.

The refrigerant regenerating apparatus may include a regenerator 10 and a recoverer 20. The regenerator 10 can separate and remove oil from the refrigerant recovered from the air conditioner. The regenerator 20 may include a compressor 13 that is used to recover a refrigerant from an air conditioner or the storage tank. The refrigerant that has passed through the regenerator 10 and the recoverer 20 can be collected into the storage tank 30.

The regenerator 10 may include a charger 11 and a collector 12. The charger 11 is connected to the first pipe Q1 and may be connected to the collector 12 through a second pipe Q2. The collector 12 may be connected to the compressor 13 of the recoverer 20 through a third pipe Q3. The third pipe Q2 may be referred to as a discharge pipe.

The charger 11 may include a discharge electrode 111, a ground electrode 112, and a power source (not indicated by a reference numeral) electrically connected to one another. The discharge electrode 111 may be disposed in the channel for a refrigerant that flows into the charger 11. The ground electrode 112 is spaced apart from the discharge electrode 111 and may be electrically connected to the discharge electrode 111. For example, the discharge electrode 111 and the ground electrode 112 may include a metallic material such as copper or tungsten. Each of the discharge electrode 111 and the ground electrode 112 may be provided as plural pieces. In this case, the discharge electrodes 111 may be disposed between the ground electrodes 112, respectively. The power source can generate corona discharge between the discharge electrode 111 and the ground electrode 112 by applying a high voltage between the discharge electrode 111 and the ground electrode 112.

Accordingly, the oil contained in the refrigerant flowing in the charger 11 through the first pipe Q1 can be charged with positive ions or negative ions by the coronal discharge. For example, when the (+) electrode of the power source is connected to the discharge electrode 111 and the (−) electrode of the power source is connected to the ground electrode 112, oil can be charged with positive ions through the charger 11. As another example, when the (−) electrode of the power source is connected to the discharge electrode 111 and the (+) electrode of the power source is connected to the ground electrode 112, oil can be charged with negative ions through the charger 11. Not only the oil contained in the refrigerant, but impurities such as sludge can be charged by the charger 11 and separated and removed from the refrigerant by the collector 12 to be described below.

The collector 12 can be provided with the refrigerant and the charged oil from the charger 11 through the second pipe Q2. The collector 12 may include a collection plate 121, a ground plate 122, and a power source (not indicated by a reference numeral) electrically connected to one another. The collection plate 121 may be disposed in the channel for a refrigerant and oil that flow into the collector 12. The ground plate 122 is spaced apart from the collection plate 121 and may be electrically connected to the collection plate 121. For example, the collection plate 121 and the ground plate 122 may include a metallic material. Each of the collection plate 121 and the ground plate 122 may be provided as plural pieces. In this case, the plurality of collection plates 121 may be disposed between the ground plates 122, respectively. In this case, the power source can generate an electric field by applying a voltage to the collection plate 121 and the ground plate 122.

Accordingly, charged oil flowing inside through the second pipe Q2 is attracted to the collection plate 121 by the electric field, so the charged oil may loose the ions by coming in contact with the collection plate 121. For example, oil charged with positive ions through the second pipe Q2 may flow into the collector 12, the (−) electrode of the power source may be connected to the collection plate 121, and the (+) electrode of the power source may be connected to the ground plate 122. Accordingly, the oil charged with positive ions is attracted to the collection plate 121, so the oil can loose the ions by coming in contact with the collection plate 121. As another example, oil charged with negative ions through the second pipe Q2 may flow into the collector 12, the (+) electrode of the power source may be connected to the collection plate 121, and the (−) electrode of the power source may be connected to the ground plate 122. Accordingly, the oil charged with negative ions is attracted to the collection plate 121, so the oil can loose the ions by coming in contact with the collection plate 121.

The collection plate 121 is elongated in a vertical direction and the oil Oi coming in contact with the collection plate 121 moves down due to its own weight, so the oil can be collected on the bottom inside the collector 12. The oil Oi collected on the bottom inside the collector 12 can be discharged outside through a discharge pipe DP.

The recoverer 20 may include a compressor 13 and a heat exchanger 14.

The compressor 13 can be provided with the refrigerant that has passed through the regenerator 10 through the third pipe Q3. In this case, the compressor 13 can compress the refrigerant flowing in the compressor 13. Accordingly, a refrigerant can be recovered well through the first pipe Q1, the second pipe Q2, and the third pipe Q3. For example, the compressor 13 may be an oilless compressor. Accordingly, it is possible to prevent the refrigerant with oil removed through the regenerator 10 from being contaminated again by oil through the compressor 13.

The heat exchanger 14 can be provided with the high-temperature and high-pressure refrigerant, which is discharged from the compressor 13, through the fourth pipe Q4. In this case, heat energy transfers to the outdoor air from the refrigerant in the heat exchanger 14, whereby the refrigerant can be condensed. In this case, the heat exchanger 14 can function as a condenser. A fan 14*a* disposed at a side of the heat exchanger 14 can adjust the amount of outdoor air passing through the heat exchanger 14.

A liquid refrigerant condensed through the heat exchanger 14 can be collected into a regenerating tank 30 through the fifth pipe Q5. The refrigerant collected in the regenerating tank 30 is a regenerated refrigerant Re with oil removed and can be provided into the air conditioner and reused as a heat transfer medium.

Figure 3:
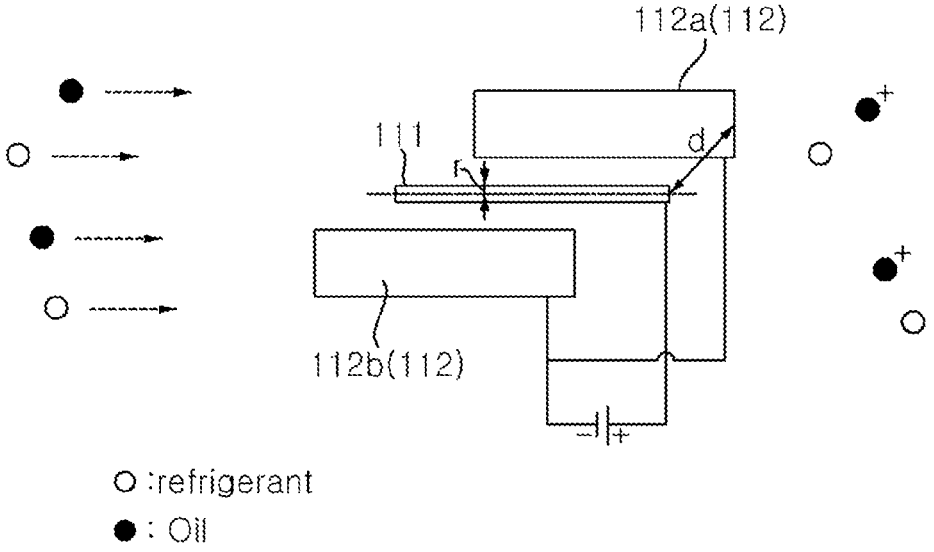
FIGS. 3 and 4 are views illustrating the shapes of a discharge electrode and a ground electrode of the charger according to an embodiment of the present disclosure.
Figure 4:
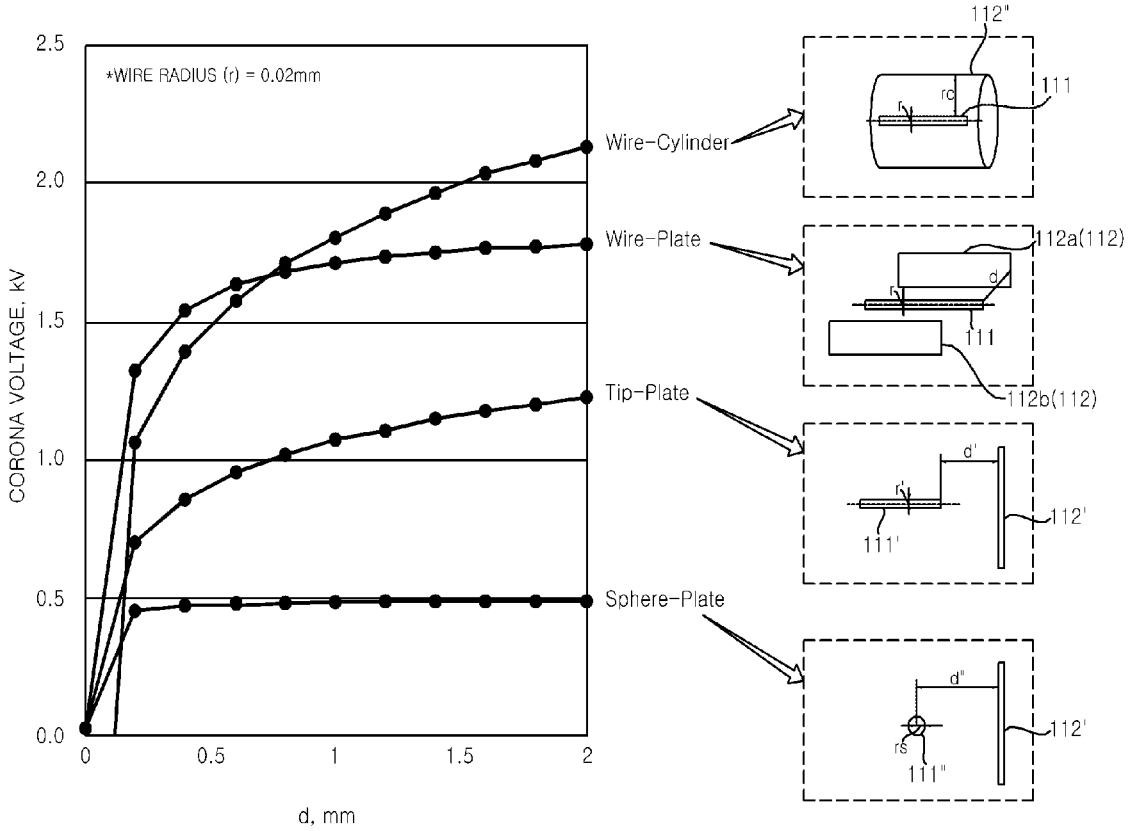

Referring to FIGS. 3 and 4, the shapes of the discharge electrode 111 and the ground electrode 112 may be varied. For example, the discharge electrode 111 may be formed in a wire, tip, or sphere shape. For example, the ground electrode 112 may be formed in a cylinder or plate shape. In this case, the combination of the discharge electrode 111 and the ground electrode 112 of the charger 11 may be a wire-cylinder type, wire-plate type, a tip-plate type, or a sphere-plate type.

As for the wire-cylinder type, a wire-shaped discharge electrode 111 may be positioned inside a cylinder-shaped ground electrode 112". The longitudinal direction of the discharge electrode 111 may be parallel with the longitudinal direction of the ground electrode 112". The radius of the discharge electrode 111 may be r and the distance from the inner surface of the ground electrode 112" to the center line of the discharge electrode 111 may be rc. For example, when the radius r of the discharge electrode 111 is 0.02 mm and the distance rc is 2 mm, a corona voltage that is a voltage for generating the corona discharge may be about 2.2 kV that is over 2.0 kV.

As for the wire-plate type, a wire-shaped discharge electrode 111 may be positioned between a pair of plate-shaped ground electrodes 112*a* and 112*b*. The longitudinal direction of the discharge electrode 111 may be parallel with the ground electrodes 112*a* and 112*b*. The radius of the discharge electrode 111 may be r and the distance from each of the ground electrodes 112*a* and 112*b* to the center line of the discharge electrode 111 may be d. For example, when the radius r of the discharge electrode 111 is 0.02 mm and the distance d is 2 mm, a corona voltage that is a voltage for generating the corona discharge may be about 1.7 kV that is under 2.0 kV.

As for the tip-plate type, the tip of a wire-shaped discharge electrode 111' may face a plate-shaped ground electrode 112'. The longitudinal direction of the discharge electrode 111 may cross or perpendicularly cross the ground electrode 112". The radius of the discharge electrode 111' may be r' and the distance from the ground electrode 112' to the tip of the discharge electrode 111' may be d'. For example, when the radius r' of the discharge electrode 111' is 0.02 mm and the distance d' is 2 mm, a corona voltage that is a voltage for generating the corona discharge may be about 1.2 kV that is under 1.5 kV.

As for the sphere-plate type, a sphere-shaped discharge electrode 111" may face a plate-shaped ground electrode 112'. The radius of the discharge electrode 111" may be rs and the distance from the ground electrode 112' to the discharge electrode 111" may be d". For example, when the radius rs of the discharge electrode 111" is 0.02 mm and the distance d" is 2 mm, a corona voltage that is a voltage for generating the corona discharge may be about 0.5 kV.

In the wire-cylinder type of the types described above, there is a difficulty that a relatively high corona voltage should be applied. In the sphere-plate type of the types described above, there is a difficulty that it is required to fly a metallic sphere in the air.

In the wire-plate type and the tip-plate type of the types described above, there is the advantage that the corona voltage that should be applied is not high, manufacturing is easy, and the charger 11 is additionally easily installed.

Figure 5:
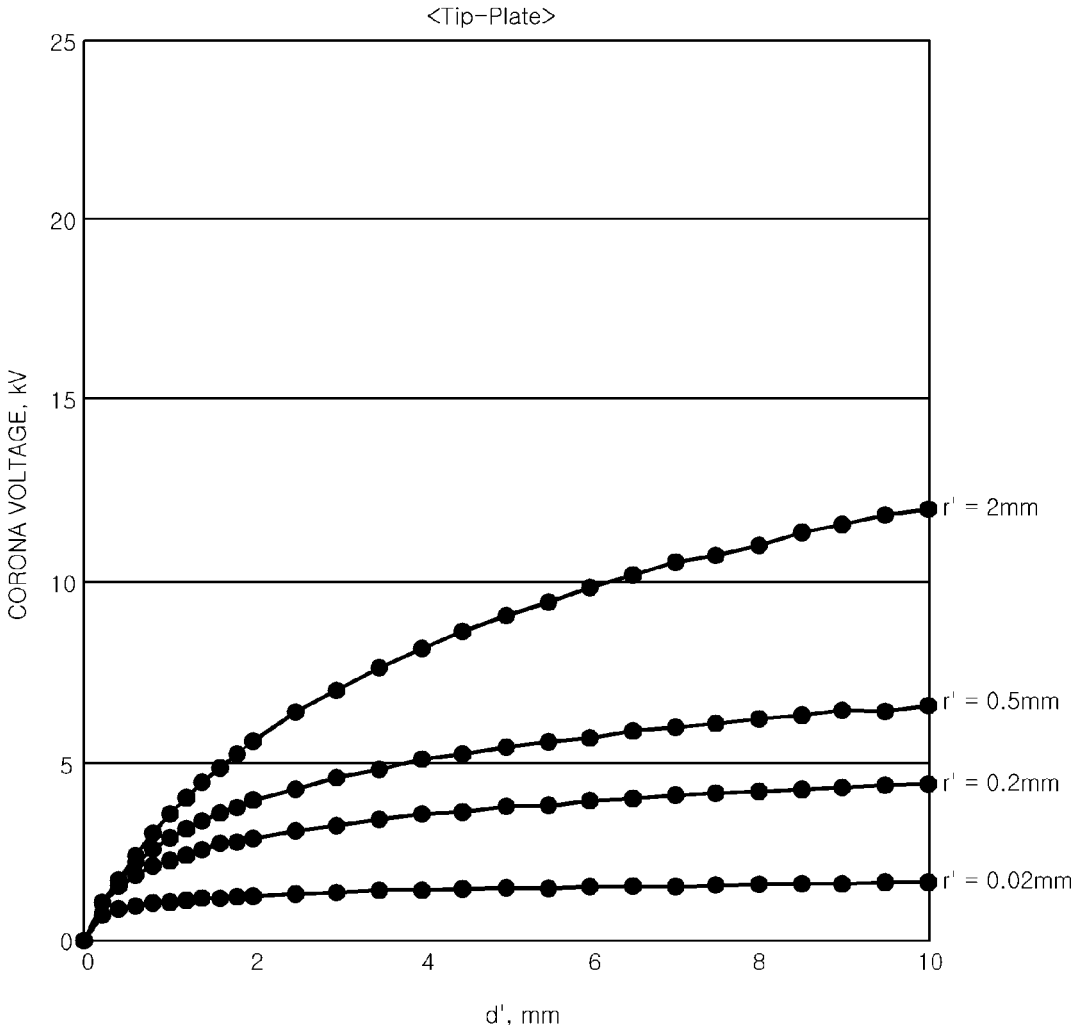
FIG. 5 is a view illustrating a tip-plate type of the charger according to an embodiment of the present disclosure.

Referring to FIGS. 4 and 5, in the tip-plate type, a change of the corona voltage according to the distance d' can be seen at a specific radius r' of the discharge electrode 111'.

When the radius r' is 0.02 mm, the radius is too small, so the wire-shaped discharge electrode 111' forming a tip may be deformed. When the radius r' is 2 mm, there is a problem that as the distance d' increases, the corona voltage greatly increases. For example, the appropriate level of the corona voltage may be 10 kV.

However, when the radius r' is 0.2 mm to 0.5 mm, it is possible to generate a corona voltage at a predetermined level in correspondence to an increase of the distance d' while preventing deformation of the discharge electrode 111'.

Figure 6:
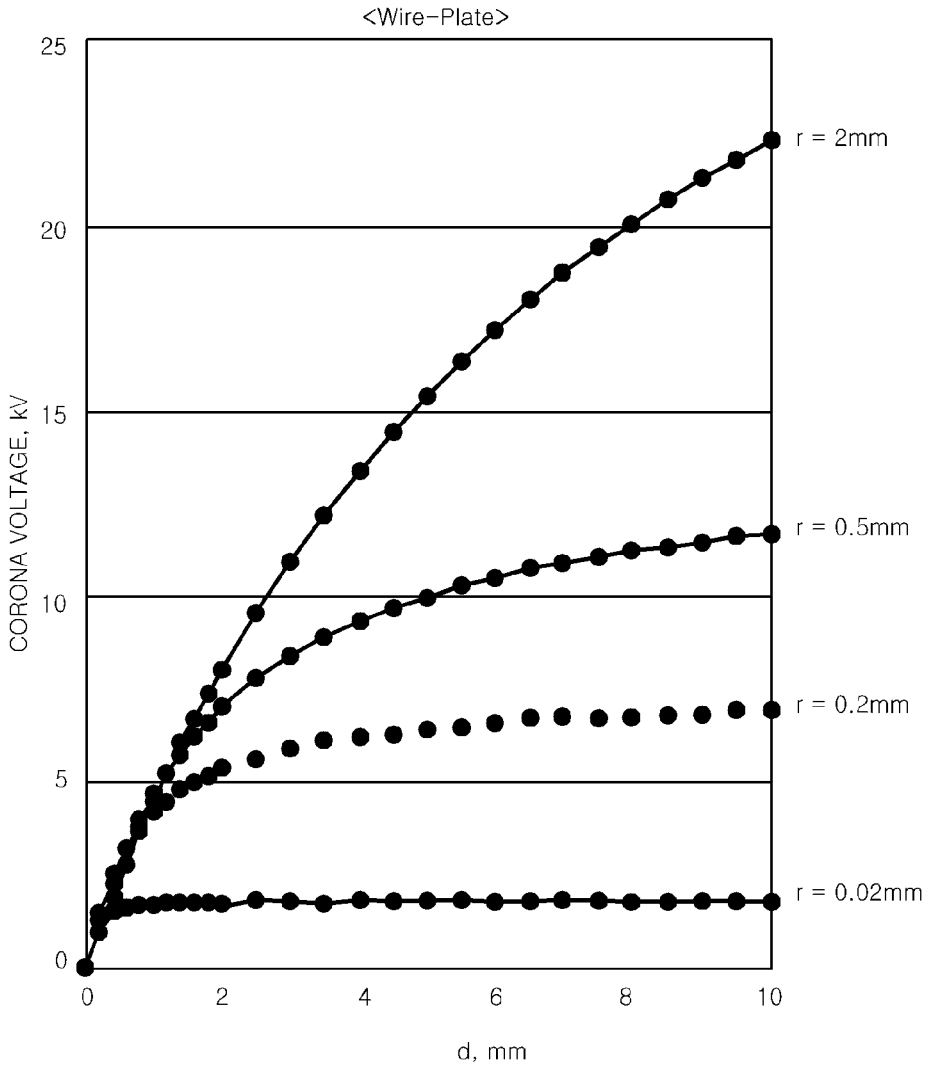
FIG. 6 is a view illustrating a wire-plate type of the charger according to an embodiment of the present disclosure.

Referring to FIGS. 4 and 6, in the wire-plate type, a change of the corona voltage according to the distance d can be seen at a specific radius r of the discharge electrode 111.

When the radius r is 0.02 mm, the radius is too small, so the wire-shaped discharge electrode 111 may be deformed or cut. When the radius r is 2 mm, there is a problem that as the distance d increases, the corona voltage greatly increases. For example, the appropriate level of the corona voltage may be 10 kV.

However, when the radius r is 0.2 mm to 0.5 mm, deformation of the discharge electrode 111 can be prevented. When the radius r is 0.2 mm, it is possible to generate a corona voltage at an appropriate level in correspondence to an increase of the distance d. When the radius r is 0.5 mm or less, it is possible to generate a corona voltage at an appropriate level in correspondence to an increase of the distance d at 3 mm or less distance d.

Referring to FIG. 7, a gaseous refrigerant and mist-state oil can flow into the charger 11 through the first pipe Q1 and can be discharged to the second pipe Q2. The oil can be charged with positive ions (or negative ions) by corona discharge through the charger 11. In this case, the charger 11 may be formed in a rectangular pipe shape and may be formed in the wire-plate type described above.

Figure 7A:
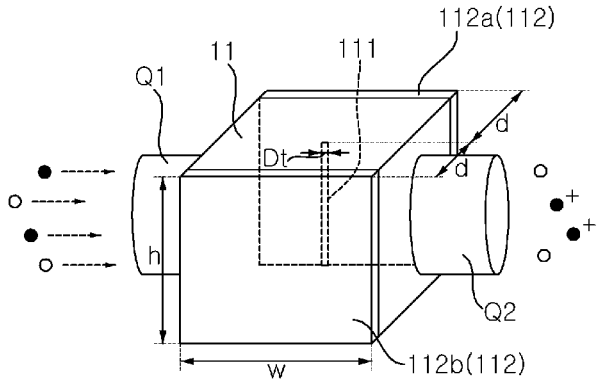
FIGS. 7A-7C are views illustrating various arrangements of the wire-plate type of the charger according to an embodiment of the present disclosure.

Referring to FIG. 7A, the discharge electrode 111 may be elongated in a direction crossing or perpendicularly crossing the direction of the channel connecting the first pipe Q1 and the second pipe Q2. The discharge electrode 111 may be disposed between a pair of ground electrodes 112*a* and 112*b*. The pair of ground electrodes 112*a* and 112*b* may form sides of the rectangular pipe-shaped charger 11. For example, the discharge electrode 111 may be spaced a predetermined distance d apart from each of the pair of ground electrodes 112*a* and 112*b*. In this case, the diameter of the discharge electrode may be Dt, and the width and height of each of the pair of ground electrodes 112*a* and 112*b* may be w and h, respectively. For example, the diameter Dt may be 0.6 mm and the distance d may be 3 mm. For example, the width w may be 22 mm and the height h may be 22 mm.

Accordingly, when a high-voltage is applied to the discharge electrode 111 and the ground electrode 112, corona discharge is generated between the discharge electrode 111 and the ground electrode 112, whereby the oil passing through the charger 11 can be charged with positive ions (or negative ions).

Figure 7B:
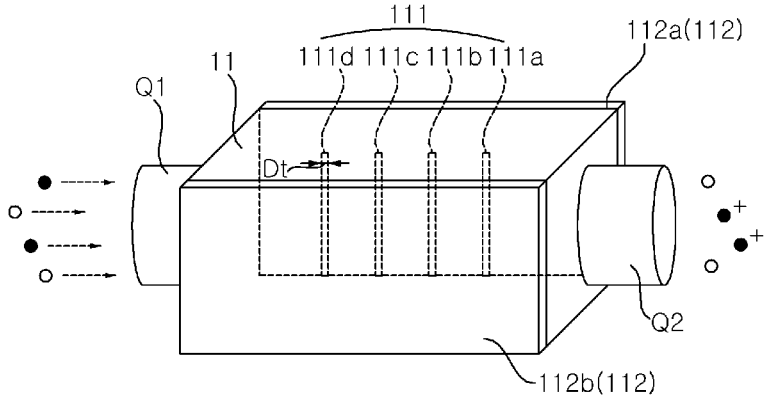

Referring to FIG. 7B, the discharge electrode 111 may include a plurality of discharge electrodes 111*a*, 111*b*, 111*c*, and 111*d* spaced apart from one another in the direction of the channel connecting the first pipe Q1 and the second pipe Q2. The width w of each of a pair of ground electrodes 112*a* and 112*b* may correspond to the arrangement distance of the plurality of discharge electrodes 111*a*, 111*b*, 111*c*, and 111*d*.

Accordingly, corona discharge is generated close to each of the plurality of discharge electrodes 111*a*, 111*b*, 111*c*, and 111*d*, so the oil passing through the charger 11 can be more easily charged with positive ions (or negative ions).

Figure 7C:
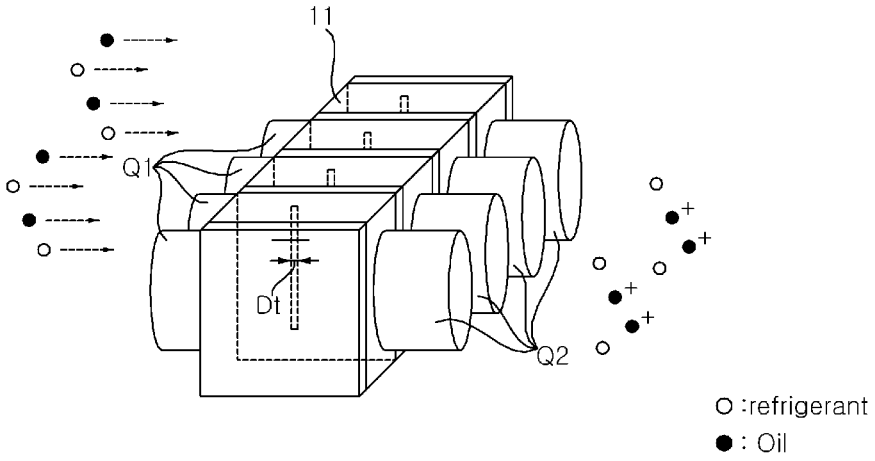

Referring to FIG. 7C, a plurality of first pipe Q1 may be provided and a plurality of second pipes Q2 may be provided to correspond to the number of the plurality of first pipes Q1. In this case, a plurality of chargers 11 may be disposed between the plurality of first pipes Q1 and the plurality of second pipes Q2.

Accordingly, oil flowing inside through each of the plurality of first pipes Q1 and passing through each of the plurality of chargers 11 can be charged with positive ions (or negative ions) and then discharged to each of the plurality of second pipes Q2. The ground electrode 112 of any one of the plurality of chargers 11 may be the same as the ground electrode 112 of another one between the plurality of first pipes Q1.

Referring to FIG. 8, a gaseous refrigerant and mist-state oil can flow into the charger 11' through the first pipe Q1 and can be discharged to the second pipe Q2. The oil can be charged with positive ions (or negative ions) by corona discharge through the charger 11'. In this case, the charger 11' may be formed entirely in a cylinder shape and may be formed in the tip-plate type described above.

Figure 8A:
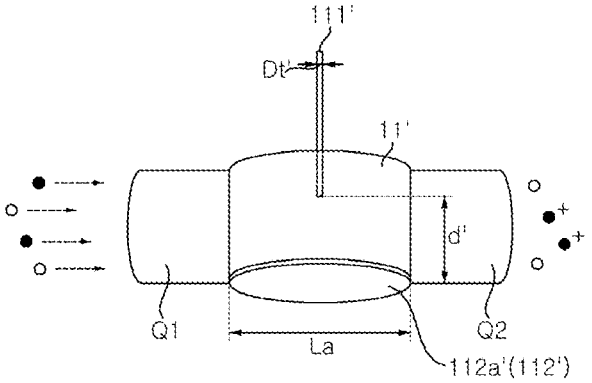
FIGS. 8A-8D are views illustrating various arrangements of the tip-plate type of the charger according to an embodiment of the present disclosure.

Referring to FIG. 8A, the discharge electrode 111' may be elongated in a direction crossing or perpendicularly crossing the direction of the channel connecting the first pipe Q1 and the second pipe Q2. A portion of the discharge electrode 111' may be inserted in the charger 11', so the tip of the discharge electrode 111' may be positioned inside the charger 11'. The ground electrode 112*a*' may be formed in a circulate plate shape and may form the bottom (or top) of the charger 11'. For example, the tip of the discharge electrode 111' may be spaced a predetermined distance d' apart from the ground electrode 112*a*'. In this case, the diameter of the discharge electrode 111' may be Dt' and the diameter of the ground electrode 112' may be La. For example, the diameter Dt' may be 1 mm and the distance d' may be 5 mm.

Accordingly, when a high-voltage is applied to the discharge electrode 111' and the ground electrode 112', corona discharge is generated between the discharge electrode 111' and the ground electrode 112', whereby the oil passing through the charger 11' can be charged with positive ions (or negative ions).

Figure 8B:
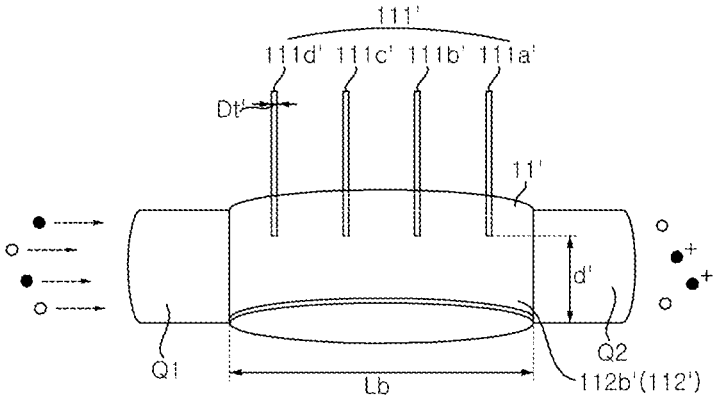

Referring to FIG. 8B, the discharge electrode 111' may include a plurality of discharge electrodes 111*a*', 111*b*', 111*c*', and 111*d*' spaced apart from one another in the direction of the channel connecting the first pipe Q1 and the second pipe Q2. In this case, the ground electrode 112*b*' may be formed in an elliptical shape and may form the bottom (or top) of the charger 11'. The width w of the long axis of the ground electrode 112*b*' may correspond to the arrangement distance of the plurality of discharge electrodes 111*a*', 111*b*', 111*c*', and 111*d*'.

Accordingly, corona discharge is generated close to each of the plurality of discharge electrodes 111*a*', 111*b*', 111*c*', and 111*d*', so the oil passing through the charger 11' can be more easily charged with positive ions (or negative ions).

Figure 8C:
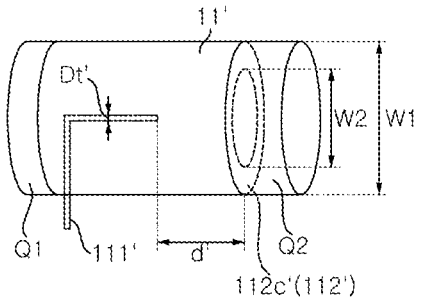

Referring to FIG. 8C, the charge 11' may be formed in a circular pipe shape elongated in the direction of the channel connecting the first pipe Q1 and the second pipe Q2. In this case, a portion of the discharge electrode 111' may be inserted in the charger 11' in a direction crossing or perpendicularly crossing the direction of the channel connecting the first pipe Q1 and the second pipe Q2 and may be bent in the direction of the channel connecting first pipe Q1 and the second pipe Q2. In other words, the discharge electrode 111' may have a first part (not indicated by a reference numeral) elongated in parallel with the ground electrode 112*c*' and a second part (not indicated by a reference numeral) connected to the first part, elongated in a direction crossing or perpendicularly crossing the ground electrode 112*c*', and having a tip.

The ground electrode 112*c*' may be disposed inside the charger 11' to be close to the second pipe Q2 and may be formed in a ring shape of which the radial direction is the same as the radial direction of the charger 11'. In this case, the outer diameter and inner diameter of the ground electrode 112*c*' may be W1 and W2, respectively, and the outer diameter W1 of the ground electrode 112*c*' may be the same as the inner diameter of the charger 11'. The tip of the discharge electrode 111' may be spaced a predetermined distance d' apart from the ground electrode 112*c*'. For example, the outer diameter W1 may be 19.05 mm and the inner diameter W2 may be 14 mm. For example, the distance d' may be 5 mm and the thickness of the ground electrode 122*c*' may be 0.5 mm Accordingly, when the first pipe Q1 and the second pipe Q2 are straightly connected through the charger 11', the discharge electrode 111' may be disposed in the charger 11' by bending the shape thereof at least one time.

Figure 8D:
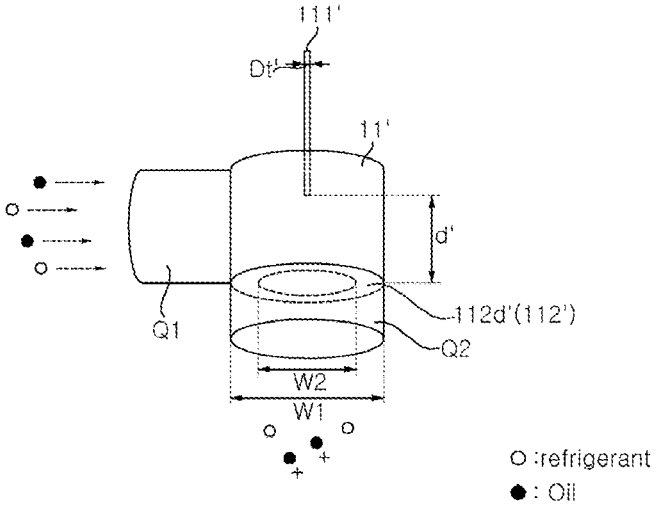

Referring to FIG. 8D, the longitudinal direction of the first pipe Q1 may cross or perpendicularly cross the longitudinal direction of the second pipe Q2. The charger 11' may be formed entirely in a cylinder shape and may connect the first pipe Q1 and the second pipe Q2. A portion of the discharge electrode 111' may extend in the longitudinal direction of the second pipe Q2 and may be inserted in the charger 11'. The ground electrode 112*d*' may be disposed inside the charger 11' to be close to the second pipe Q2 and may be formed in a ring shape of which the radial direction is the same as the radial direction of the charger 11'. In this case, the outer diameter and inner diameter of the ground electrode 112*d*' may be W1 and W2, respectively, and the outer diameter W1 of the ground electrode 112*d*' may be the same as the inner diameter of the charger 11'. The tip of the discharge electrode 111' may be spaced a predetermined distance d' apart from the ground electrode 112*d*'.

Accordingly, when the first pipe Q1 and the second pipe Q2 are connected to make a curve through the charger 11', the discharge electrode 111' may be formed and disposed straight in the charger 11'.

Figure 9:
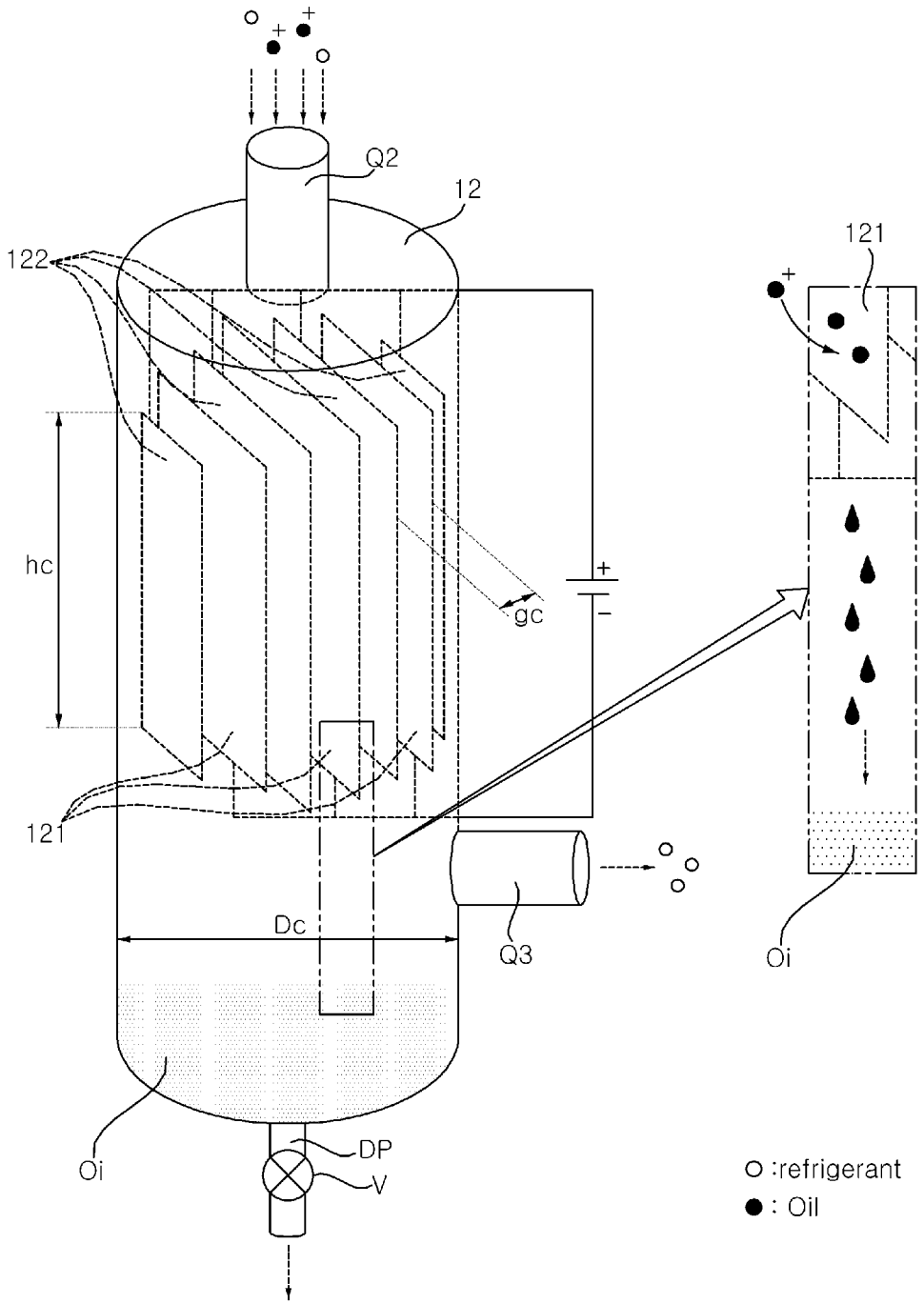
FIGS. 9 and 10 are views illustrating the collector according to an embodiment of the present disclosure, in which a collection plate and a ground plate of the collector are shown as flat plates in FIG. 9 and as rolled plates in FIG. 10.

Referring to FIG. 9, the collector 12 can be provided with a refrigerant and charged oil from the charger 11 through the second pipe Q2. For example, the collector 12 may be formed entirely in a cylinder shape. In this case, the second pipe Q2 may be connected to the top of the collector 12, the third pipe Q3 may be connected to a side of the collector 12, and the discharge pipe Dp may be connected to the bottom of the collector 12.

The collector 12 may include a plurality of collection plates 121 and a plurality of ground plates 122. In this case, the plurality of collection plates 121 may be disposed between the ground plates 122, respectively. A power source (not indicated by a reference numeral) can generate an electric field by applying a voltage to the collection plate 121 and the ground plate 122.

For example, a plurality of collection plates 121 and a plurality of ground plates 122 may be flat plates and may be spaced a predetermined gap gc apart from each other. The plurality of collection plates 121 and the plurality of ground plates 122 may be elongated in the longitudinal direction of the collector 12.

Accordingly, charged oil flowing inside through the second pipe Q2 is attracted to the collection plate 121 by the electric field, so the charged oil may loose the ions by coming in contact with the collection plate 121. For example, oil charged with positive ions through the second pipe Q2 may flow into the collector 12, the (−) electrode of the power source may be connected to the collection plate 121, and the (+) electrode of the power source may be connected to the ground plate 122. Accordingly, the oil charged with positive ions is attracted to the collection plate 121, so the oil can loose the ions by coming in contact with the collection plate 121. As another example, oil charged with negative ions through the second pipe Q2 may flow into the collector 12, the (+) electrode of the power source may be connected to the collection plate 121, and the (−) electrode of the power source may be connected to the ground plate 122. Accordingly, the oil charged with negative ions is attracted to the collection plate 121, so the oil can loose the ions by coming in contact with the collection plate 121.

The oil Oi coming in contact with the collection plate 121 moves down due to its own weight, so the oil can be collected on the bottom inside the collector 12. The oil Oi collected on the bottom inside the collector 12 can be discharged outside through a discharge pipe DP. To this end, a discharge valve V can open the channel of the discharge pipe DP.

Meanwhile, a gaseous refrigerant can flow into the compressor 13 describe above through the collector 12 and the third pipe Q3.

Figure 10:
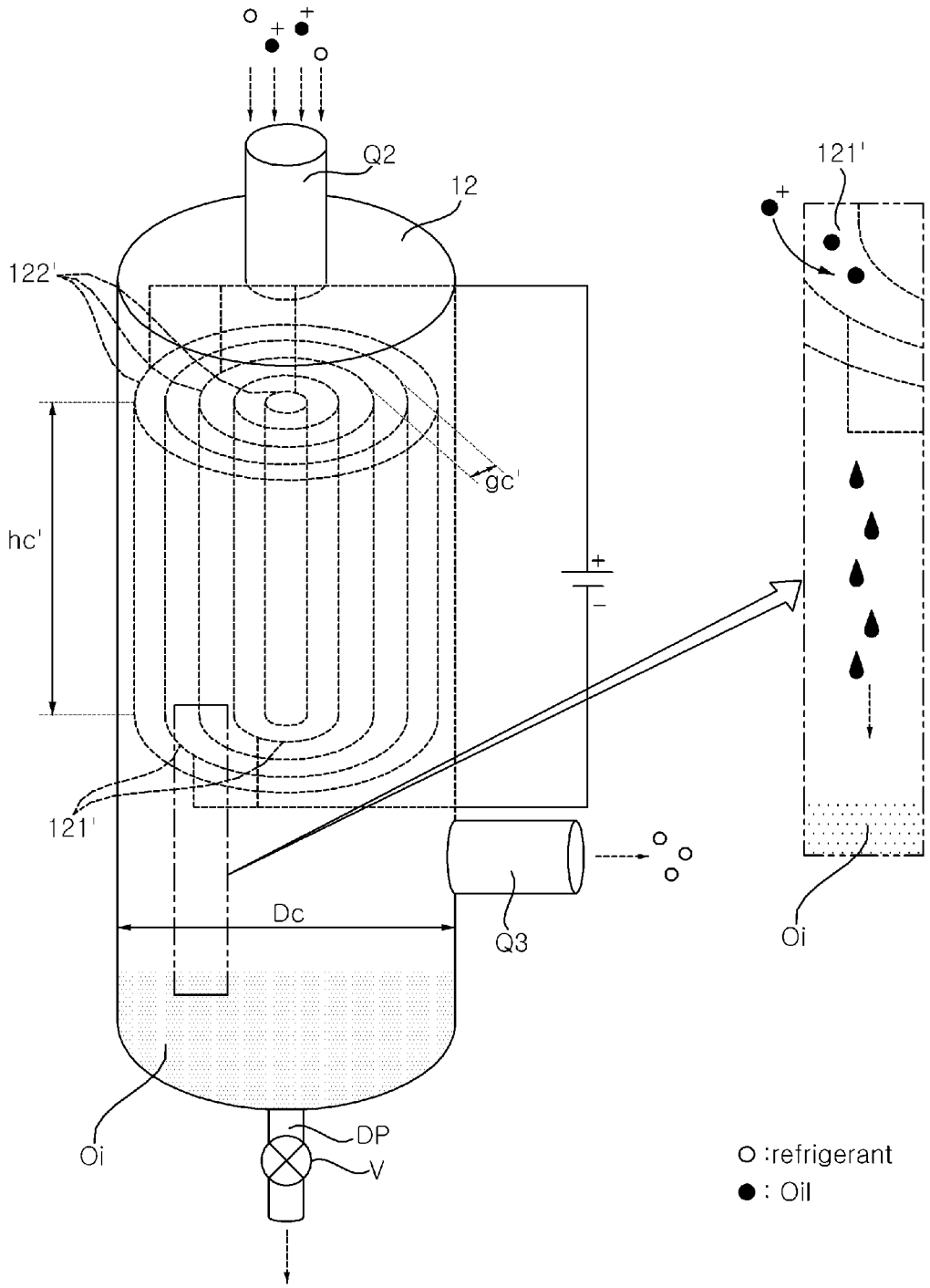

Referring to FIG. 10, the collector 12 may include a plurality of collection plates 121' and a plurality of ground plates 122'. In this case, the plurality of collection plates 121' may be disposed between the ground plates 122', respectively. A power source (not indicated by a reference numeral) can generate an electric field by applying a voltage to the collection plate 121 and the ground plate 122.

For example, a plurality of collection plates 121' and a plurality of ground plates 122' may be formed in a roll shape and may be spaced a predetermined gap gc' apart from each other. The plurality of collection plates 121' and the plurality of ground plates 122' may be elongated in the longitudinal direction of the collector 12.

Accordingly, compared with the collection plates and ground plates that have a plate shape described with reference to FIG. 9, the surface area that is brought in contact with oil increases, so the efficiency of separating and removing oil can be increased.

According to an aspect of the present disclosure, there is provided a refrigerant regenerating apparatus including: a regenerator into which a refrigerant flows and from which the refrigerant is discharged, the regenerator configured to separate and discharge oil contained in a refrigerant flowing in the regenerator; and a recoverer into which the refrigerant discharged from the regenerator flows, the recoverer including a compressor configured to compress a refrigerant flowing in the recoverer and a heat exchanger configured to condense a refrigerant discharged from the compressor, in which the regenerator includes: a charger configured to charge oil contained in the refrigerant flowing in the regenerator with positive ions or negative ions using corona discharge; and a collector configured to electrically collect the oil charged through the charger.

According to another aspect of the present disclosure, the charger may further include: a discharge electrode disposed in a channel for a refrigerant flowing into the charger; a ground electrode spaced apart from the discharge electrode and electrically connected to the discharge electrode; and a power source configured to apply a voltage between the discharge electrode and the ground electrode.

According to another aspect of the present disclosure, the discharge electrode may be formed in a wire shape and the ground electrode may be formed in a plate shape.

According to another aspect of the present disclosure, the ground electrode may further include a pair of ground electrodes spaced apart from each other with the discharge electrode therebetween, and the discharge electrode may be elongated in parallel with the pair of ground electrodes.

According to another aspect of the present disclosure, the longitudinal direction of the discharge electrode may cross the flow direction of a refrigerant flowing into the charger.

According to another aspect of the present disclosure, the discharge electrode may further include a plurality of discharge electrodes spaced apart from each other in the flow direction of a refrigerant flowing into the charger, and the width of the pair of ground electrodes may correspond to an arrangement length of the plurality of discharge electrodes.

According to another aspect of the present disclosure, the discharge electrode may be elongated in a direction crossing the ground electrode and may have a tip facing the ground electrode.

According to another aspect of the present disclosure, the tip of the discharge electrode may be disposed in the channel for the refrigerant flowing into the charger, and the ground electrode may be a circular plate or a ring-shaped plate.

According to another aspect of the present disclosure, the discharge electrode may further include a plurality of discharge electrodes spaced apart from each other in the flow direction of a refrigerant flowing into the charger, and the width of the ground electrode may correspond to an arrangement length of the plurality of discharge electrodes.

According to another aspect of the present disclosure, the discharge electrode may further include: a first part elongated in parallel with the ground electrode; and a second part connected to the first part, elongated in a direction crossing the ground electrode, and having a tip.

According to another aspect of the present disclosure, the collector may further include: a collection plate disposed in a channel for a refrigerant flowing into the collector; a ground plate spaced apart from the collection plate and electrically connected to the collection plate; and a power source generating an electric field by applying a voltage to the collection plate and the ground plate.

According to another aspect of the present disclosure, the collection plate may be elongated in a vertical direction; the oil charged through the charger may flow to the collection plate and may be collected on the collection plate together with the refrigerant passing through the charger, and may be moved down along the collection plate and accumulated on the bottom inside the collector; and the collector may further include a discharge pipe configured to discharge the oil accumulated on the bottom inside the collector, and a discharge pipe configured to discharge the refrigerant flowing in the collector.

According to another aspect of the present disclosure, the collection plate may further include a plurality of collection plates each being a flat plate and spaced apart from each other, and the ground plate may further include a plurality of ground plates each being a flat plate and disposed between the plurality of collection plates.

According to another aspect of the present disclosure, the collection plate may further include a plurality of collection plates each formed in a roll shape and spaced apart from each other, and the ground plate may further include a plurality of ground plates each formed in a roll shape and disposed between the plurality of collection plates.

Effects of the refrigerant regenerating apparatus according to the present disclosure are as follows.

According to at least one embodiment of the present disclosure, it is possible to provide a refrigerant regenerating apparatus that can electrically separate a refrigerant and oil by charging oil contained in a refrigerant to have one polarity using corona discharge.

According to at least one embodiment of the present disclosure, it is possible to provide a refrigerant regenerating apparatus that can remove charged oil from a refrigerant by electrically collecting the charged oil.

Some embodiments or other embodiments of the present disclosure described above are not exclusive or discriminated from each other. The configurations or functions of some embodiments or other embodiments of the present disclosure described above may be simultaneously used or combined.

For example, it means that the configuration A described in a specific embodiment and/or the drawings and the configuration B described in another embodiment and/or the drawings may be combined. That is, it means that even if combination of configurations is not directly described, combination is possible unless it is described that combination is impossible.

The detailed description should not be construed as being limited in all respects and should be construed as an example. The scope of the present disclosure should be determined by reasonable analysis of the claims and all changes within an equivalent range of the present disclosure is included in the scope of the present disclosure.

What is claimed is:

1. A refrigerant regenerating apparatus comprising:

a regenerator into which a refrigerant flows and from which the refrigerant is discharged, the regenerator configured to separate and discharge oil contained in a refrigerant flowing in the regenerator; and a recoverer into which the refrigerant discharged from the regenerator flows, the recoverer including a compressor configured to compress a refrigerant flowing in the recoverer and a heat exchanger configured to condense a refrigerant discharged from the compressor, wherein the regenerator comprises:

a charger configured to charge oil contained in the refrigerant flowing in the regenerator with positive ions or negative ions using corona discharge; and a collector configured to electrically collect the oil charged through the charger.

2. The refrigerant regenerating apparatus of claim 1, wherein the charger further comprises:

a discharge electrode disposed in a channel for a refrigerant flowing into the charger;

a ground electrode spaced apart from the discharge electrode and electrically connected to the discharge electrode; and a power source configured to apply a voltage between the discharge electrode and the ground electrode.

3. The refrigerant regenerating apparatus of claim 2, wherein the discharge electrode is formed in a wire shape and the ground electrode is formed in a plate shape.

4. The refrigerant regenerating apparatus of claim 2, wherein the ground electrode further comprises a pair of ground electrodes spaced apart from each other with the discharge electrode therebetween, and the discharge electrode is elongated in parallel with the pair of ground electrodes.

5. The refrigerant regenerating apparatus of claim 4, wherein the longitudinal direction of the discharge electrode crosses the flow direction of a refrigerant flowing into the charger.

6. The refrigerant regenerating apparatus of claim 5, wherein the discharge electrode further includes a plurality of discharge electrodes spaced apart from each other in the flow direction of a refrigerant flowing into the charger, and the width of the pair of ground electrodes corresponds to an arrangement length of the plurality of discharge electrodes.

7. The refrigerant regenerating apparatus of claim 3, wherein the discharge electrode is elongated in a direction crossing the ground electrode and has a tip facing the ground electrode.

8. The refrigerant regenerating apparatus of claim 7, wherein the tip of the discharge electrode is disposed in the channel for the refrigerant flowing into the charger, and the ground electrode is a circular plate or a ring-shaped plate.

9. The refrigerant regenerating apparatus of claim 8, wherein the discharge electrode further comprises a plurality of discharge electrodes spaced apart from each other in the flow direction of a refrigerant flowing into the charger, and the width of the ground electrode corresponds to an arrangement length of the plurality of discharge electrodes.

10. The refrigerant regenerating apparatus of claim 7, wherein the discharge electrode further comprises: a first part elongated in parallel with the ground electrode; and a second part connected to the first part, elongated in a direction crossing the ground electrode, and having a tip.

11. The refrigerant regenerating apparatus of claim 1, wherein the collector further comprises:

a collection plate disposed in a channel for a refrigerant flowing into the collector;

a ground plate spaced apart from the collection plate and electrically connected to the collection plate; and a power source generating an electric field by applying a voltage to the collection plate and the ground plate.

12. The refrigerant regenerating apparatus of claim 11, wherein the collection plate is elongated in a vertical direction, the oil charged through the charger flows to the collection plate and is collected on the collection plate together with the refrigerant passing through the charger, and is moved down along the collection plate and accumulated on the bottom inside the collector; and the collector further comprises a discharge pipe configured to discharge the oil accumulated on the bottom inside the collector, and a discharge pipe configured to discharge the refrigerant flowing in the collector.

13. The refrigerant regenerating apparatus of claim 11, wherein the collection plate further comprises a plurality of collection plates each being a flat plate and spaced apart from each other, and the ground plate further comprises a plurality of ground plates each being a flat plate and disposed between the plurality of collection plates.

14. The refrigerant regenerating apparatus of claim 11, wherein the collection plate further comprises a plurality of collection plates each formed in a roll shape and spaced apart from each other, and the ground plate further comprises a plurality of ground plates each formed in a roll shape and disposed between the plurality of collection plates.

* * * * *